US008555537B2

(12) United States Patent
Pflaumer et al.

(10) Patent No.: US 8,555,537 B2
(45) Date of Patent: Oct. 15, 2013

(54) BREECH DEVICE HAVING AN INTERNALLY MOUNTED FUNCTIONAL MEMBER

(75) Inventors: Wulf H. Pflaumer, Arnsberg (DE); Franz Wonisch, Arnsberg (DE); Stefan Eith, Neu-Ulm (DE)

(73) Assignee: Carl Walther GmbH, Ulm (DE)

( * ) Notice: Subject to any disclaimer, the term of this patent is extended or adjusted under 35 U.S.C. 154(b) by 27 days.

(21) Appl. No.: 13/253,107

(22) Filed: Oct. 5, 2011

(65) Prior Publication Data

US 2012/0192472 A1 Aug. 2, 2012

(30) Foreign Application Priority Data

Oct. 5, 2010 (DE) ..... 10 2010 047 500

(51) Int. Cl.
*F41A 3/00* (2006.01)
*F41A 3/64* (2006.01)

(52) U.S. Cl.
USPC ..... 42/14

(58) Field of Classification Search
USPC ..... 42/14, 16, 17, 18, 7
See application file for complete search history.

(56) References Cited

U.S. PATENT DOCUMENTS

| | | | | | |
|---|---|---|---|---|---|
| 3,724,326 | A * | 4/1973 | Day | 89/196 |
| 3,728,939 | A * | 4/1973 | Wilhelm | 89/196 |
| 3,772,812 | A * | 11/1973 | Day | 42/7 |
| 4,409,882 | A * | 10/1983 | Blackshaw et al. | 89/163 |
| 4,589,327 | A * | 5/1986 | Smith | 89/148 |
| 4,594,935 | A * | 6/1986 | Smith | 89/176 |
| 4,615,132 | A * | 10/1986 | Smith | 42/25 |
| 5,024,016 | A * | 6/1991 | Smith | 42/25 |
| 5,325,617 | A * | 7/1994 | Vojta et al. | 42/75.03 |
| 5,355,768 | A * | 10/1994 | Felk | 89/147 |
| 5,655,326 | A * | 8/1997 | Levavi et al. | 42/70.01 |
| 6,363,831 | B2 * | 4/2002 | Gussalli Beretta | 89/163 |
| 7,694,449 | B1 * | 4/2010 | Pontillo, II | 42/71.02 |
| 2001/0029688 | A1 * | 10/2001 | Beretta | 42/75.04 |

FOREIGN PATENT DOCUMENTS

| | | | |
|---|---|---|---|
| EP | 319261 | A1 * | 6/1989 |
| GB | 2137323 | A * | 10/1984 |

* cited by examiner

*Primary Examiner* — Jonathan C Weber
(74) *Attorney, Agent, or Firm* — Bachman & LaPointe, P.C.

(57) ABSTRACT

A breech device (100) for a handgun has an impact base (120) in a central recess (110) in said breech device (100). The impact base (120) is in the form of a front end face of an impact-base member (160) in the central recess. A main functional region (150) is between said impact base (120) and a rear end face (140) of said breech device. At least one percussion member (300) for firing a cartridge and also a surface of a cartridge slide (211) are in the main functional region (150). The surface of the cartridge slide (211) is adapted to abut cartridges mounted in a magazine (100) in a neutral position of the breech device.

10 Claims, 4 Drawing Sheets

BREECH DEVICE HAVING AN INTERNALLY MOUNTED FUNCTIONAL MEMBER

CROSS-REFERENCE TO RELATED APPLICATION

Priority is claimed of DE102010047500.9, filed Oct. 5, 2010, the disclosure of which is incorporated by reference herein in its entirety as if set forth at length.

BACKGROUND OF THE INVENTION

The invention relates to a breech device for a handgun, which breech device comprises an impact base that is disposed in a central recess of the breech device and that is in the form of a front end face of an impact-base member disposed in the central recess, and a main functional region, which is disposed between the impact base and a rear end face of the breech device and in which at least one percussion member for firing a cartridge and a cartridge slide are disposed, the cartridge slide being adapted to abut cartridges mounted in a magazine in a neutral position of the breech device.

Breech devices of the above type are used in the prior art to carry out an automatic repeating action of a handgun. However, the known breech devices suffer from the disadvantage that the production of an internal functional surface with at least one morphologically structured internal functional guiding surface or, more particularly, a number of different morphologically structured internal functional guiding surfaces, necessitates high machining costs in the manufacturing process, as a result of which the production of a breech device accounts for a high percentage of the total production costs of a handgun.

SUMMARY OF THE INVENTION

It is therefore an object of the invention to provide a breech device involving production costs that are lower than those of known breech devices but displaying the same quality and reliability.

For a breech device of the above type, this object is achieved, according to the invention, in that the main functional region is in the form of a main functional element that forms a compact unit and is capable of being releasably anchored securely by means of a fixing device in a pre-defined position in an internal profile of the central recess of the breech device.

Preferred embodiments of the invention are the subject matter of the subordinate claims.

In the breech device of the invention, the combination of features, namely the provision of the main functional region in the form of a main functional element that forms a compact unit and is capable of being releasably anchored securely by means of a fixing device in a pre-defined position in an internal profile of the central recess of the breech device, results in a breech device that can be assembled securely from at least two cheaply and separately producible components to form a robust unit. The two components can be made of different materials, if desired, and use may be made of plastics materials, if appropriate. Usually, the main functional element has a morphologically structured functional shape, which can be created more simply and at less expense when produced as a separate component rather than as part of an internal structure of a breech block.

According to a first preferred embodiment of the breech device of the invention, provision is made for the main functional element to be made of a rigid plastics material. The main functional element can be provided with cavities at different locations for the purpose of pre-determining its mechanical properties and its elasticity. In particular, these cavities can also be configured to accommodate additional functional units.

Additionally or alternatively, the main functional element can be, at least partially, of a honeycomb design.

According to an important preferred embodiment of the breech device of the invention, provision is made for the cartridge slide to be located on a metallic sliding member that is securely anchored in the main functional element.

According to another preferred embodiment of the breech device of the invention, provision is made for the main functional element mounted in the internal profile of the main functional region to bear with its front end face against a rear end face of an impact-base member provided in the form of a bridge inside the central recess. The bridge can be provided with a protrusion that bears against the sliding member of the cartridge slide when the main functional element is mounted in the internal profile of the main functional region.

Furthermore, the main functional element is preferably provided with a bore, which extends in the direction of the longitudinal axis of the main functional element and in which a percussion member in the form of a bolt for firing a cartridge is mounted for reciprocal movement.

Preferably, in the region of the front end face of the main functional element, there is provided a protrusion, which can be moved into a corresponding recess in the bridge and through which the bore extending in the direction of the longitudinal axis of the main functional element is guided for mounting the percussion member, a bore leading to the impact base being provided within the bridge in the form of an extension of the longitudinally extending bore of the main functional element.

According to another preferred embodiment of the breech device of the invention, provision is made for the fixing device to be in the form of an anchor pin, which is anchored in mutually opposing outer walls of the breech device and which is mounted securely in a transverse bore of the main functional element.

According to a particularly preferred embodiment, the main functional element comprises two mutually opposing dovetails or portions in a region located close to the rear end face of the breech device, which portions are biased in the direction extending away from each other in order to apply a pre-defined pressure against the mutually opposing outer walls of the breech block for the purpose of achieving releasable anchorage of the main functional element.

Accordingly, a rear end face of a breech block is configured to be open for inserting the main functional element in order to make it possible to subsequently insert the main functional element into the breech blank.

BRIEF DESCRIPTION OF THE DRAWINGS

The breech device of the invention is explained below with reference to a preferred embodiment illustrated in the figures of the drawing, in which.

DETAILED DESCRIPTION

Figure 1:
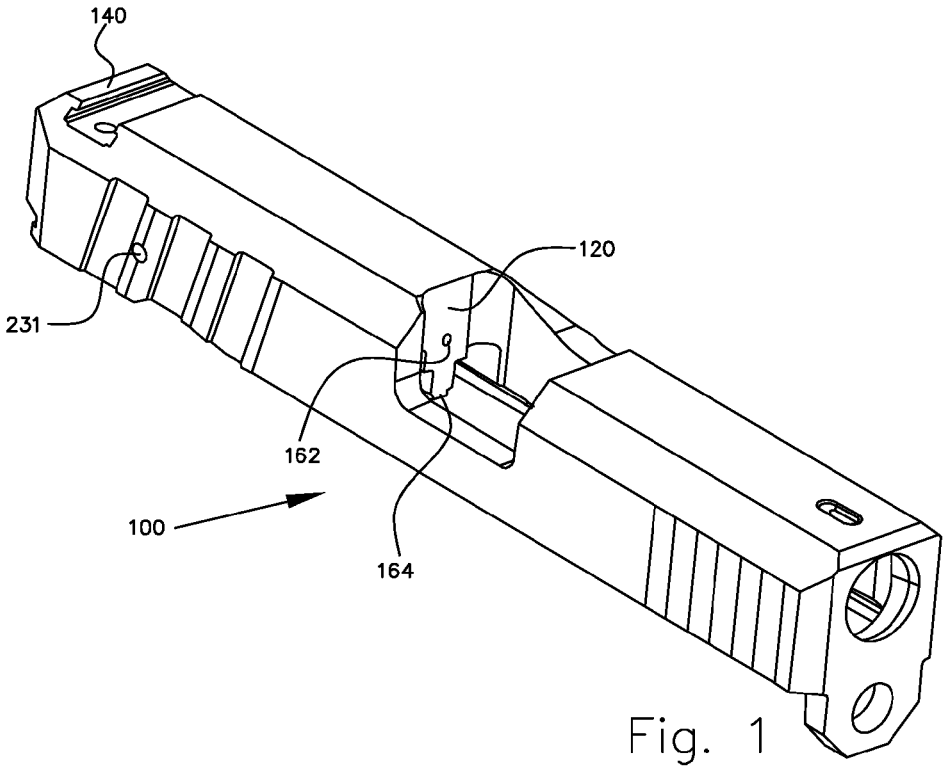
FIG. 1 shows a preferred embodiment of the breech device of the invention as a front view taken obliquely from above.
Figure 1A:
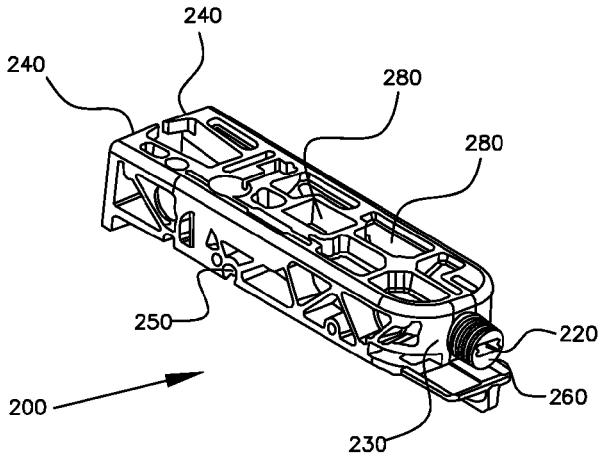
FIG. 1A shows a main functional element for use in the preferred embodiment of the breech device of the invention shown in FIG. 1 as a front view taken obliquely from below.
Figure 2:
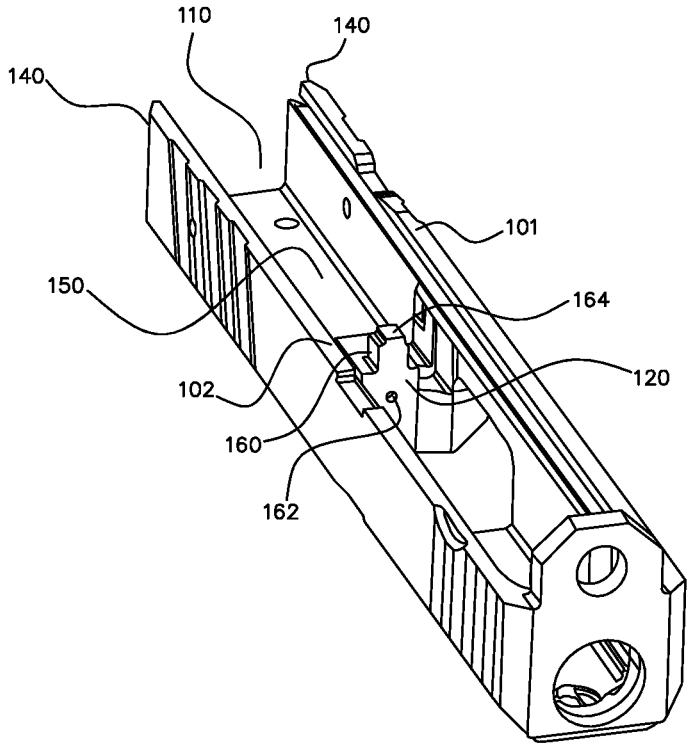
FIG. 2 shows the preferred embodiment of the breech device of the invention shown in FIG. 1 as a front view taken obliquely from below.
Figure 2A:
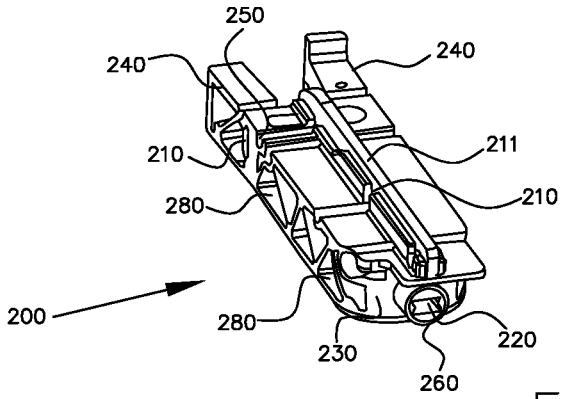
FIG. 2A shows the main functional element shown in FIG. 1A as a front view taken obliquely from below.
Figure 3:
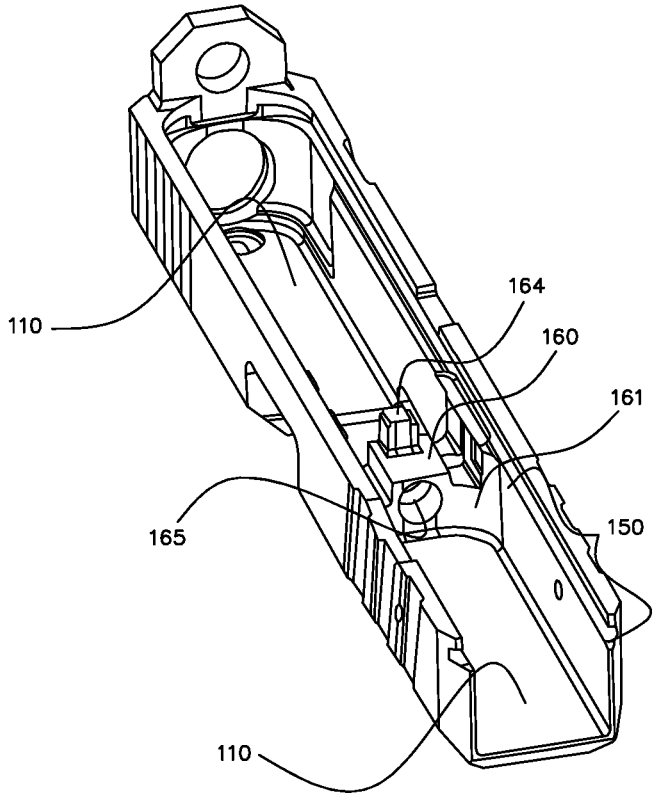
FIG. 3 shows the preferred embodiment of the breech device of the invention shown in FIG. 1 as a rear view taken obliquely from below.
Figure 3A:
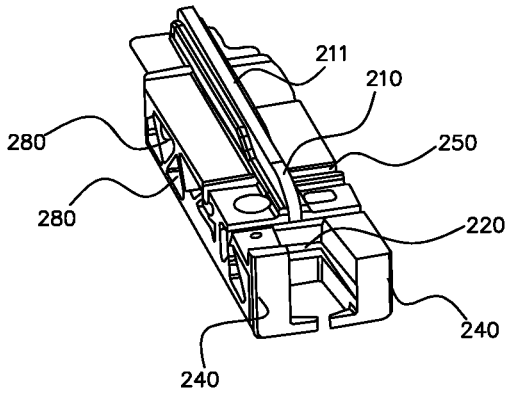
FIG. 3A shows the main functional element shown in FIG. 1A as a rear view taken obliquely from below.
Figure 4:
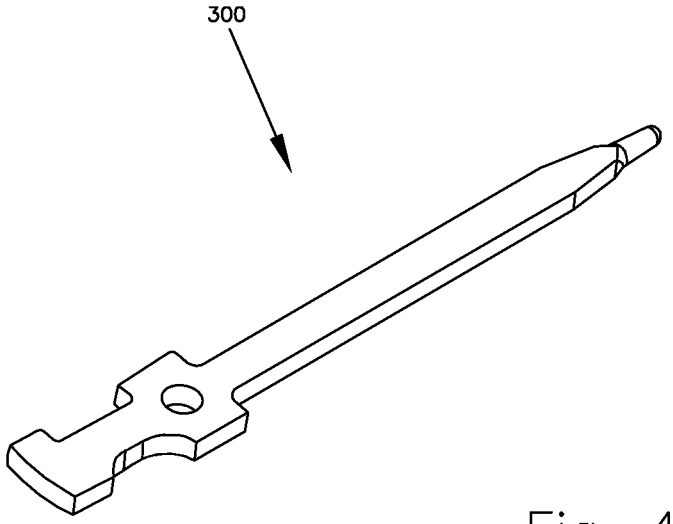
FIG. 4 shows a firing pin for use in the embodiment of the breech device of the invention shown in FIGS. 1 to 3A as a view taken obliquely from above.

The breech device 100 of the invention, which is intended for use in a handgun and is shown in FIGS. 1 to 3 in its entirety and in FIGS. 1A to 4 as detailed views, comprises a impact base 120 disposed in a central recess 110 of the breech device 100 and having the form of a front end face of a impact-base member 160 disposed in the central recess. Between the impact base 120 and a rear end face 140 of the breech device, there is disposed a main functional region 150, in which a percussion member 300 for firing a cartridge and a cartridge slide 211 are disposed. The cartridge slide 211 is configured so as to abut cartridges mounted in a magazine in a neutral position of the breech device 100.

The main functional region 150 is in the form of a main functional element 200 that forms a compact unit and that can be anchored securely and releasably by means of a fixing device in a pre-defined position in an internal profile of the central recess 110 of the breech device 100.

The main functional element 200 is made of a rigid plastics material and is at least partially of a honeycomb design. Cavities 280 of the honeycomb may be provided to define the mechanical properties (e.g., elasticity) of the main functional element and accommodate particular functional units.

The cartridge slide 211 is provided on a metallic sliding member 210 that is securely anchored in the main functional element 200.

The main functional element 200 mounted in the internal profile of the main functional region 150 bears with its front end face 230 against a rear end face 161 of a impact-base member 160 provided in the form of a bridge 160 inside the central recess. The bridge 160 is provided with a protrusion 164 that bears against the sliding member 210 of the cartridge slide 211 when the main functional element 200 is mounted in the internal profile of the main functional region 150.

Furthermore, the main functional element 200 is provided with a bore 220, which extends in the direction of the longitudinal axis of the main functional element 200 and in which a percussion member 300 in the form of a bolt for firing a cartridge is mounted for reciprocal movement therein.

In the region of the front end face 230 of the main functional element 200, there is provided a protrusion 260, which can move into a corresponding recess 165 in the bridge 160 and through which the bore 220 extending in the direction of the longitudinal axis of the main functional element 200 is guided for mounting the percussion member 300, a bore 162 leading to the impact base being provided within the bridge 160 in the form of an extension of the longitudinally extending bore 220 in the main functional element 200.

The fixing device is in the form of an anchor pin 231, which is anchored in mutually opposing outer walls 101, 102 of the breech device 100 and which is positively mounted in a transverse bore 250 in the main functional element 200.

In a region located close to the rear end face 140 of the breech device, the main functional element 200 comprises two mutually opposing portions 240 that are biased in the direction extending away from each other in order to apply a pre-defined pressure to the mutually opposing outer walls 101, 102 of the breech device 100 for the purpose of achieving a releasable anchorage of the main functional element.

A rear end face of the breech device is configured to be open so as to make it possible to insert the main functional element 200.

The exemplary embodiment of the invention described above merely serves the purpose of providing better comprehension of the teaching of the invention defined in the claims, which teaching is not, as such, restricted to the exemplary embodiment.

We claim:

1. A breech device (100) for a handgun, comprising an impact base (120) that is disposed in a central recess (110) in said breech device (100) and is in the form of a front end face of an impact member (160) disposed in the central recess and a main functional region (150) disposed between said impact base (120) and a rear end face (140) of said breech device and in which at least one percussion member (300) for firing a cartridge and also a surface of a cartridge slide (211) are disposed and the surface of said cartridge slide (211) is adapted to abut cartridges mounted in a magazine (100) in a neutral position of said breech device, characterized in that:

the main functional region (150) includes a main functional member (200) forming a compact unit that can be releasably anchored securely by means of a fixing device in a predefined position in an internal profile of said central recess (110) in said breech device (100);

said main functional member (200) is mounted in the internal profile of said main functional region (150) and terminates, with its front end face (230), in the region of a rear end face (161) of an impact member taking the form of a bridge (160) disposed in said central recess (110);

said bridge (160) is provided with a protrusion (164) which, when said main functional member (200) is mounted in said internal profile in said main functional region (150), abuts said sliding member (210) on the surface of said cartridge slide (211); and in the region of the front end face (230) of said main functional member (200) there is formed a protrusion (260) capable of moving into a corresponding recess (165) in said bridge (160), through which protuberance the bore (220) extending axially in the longitudinal direction for the accommodation of said percussion member (300) is disposed, and within said bridge (160) a bore (162) is provided which leads to the impact base and forms a continuation of the bore (220) extending through the main functional member (200) axially in the longitudinal direction.

2. The device as defined in claim 1, characterized in that said main functional member (200) is made of a rigid plastics material.

3. The device as defined in claim 1, characterized in that said main functional member (200) is provided with cavities (280) at various sites.

4. The device as defined in claim 3, characterized in that said cavities (280) are adapted to accommodate particular functional units.

5. The device as defined in claim 1, characterized in that the surface of said cartridge slide (211) is formed on a metallic sliding member (210) that is securely anchored to said main functional member (200).

6. The device as defined in claim 1, characterized in that said main functional member (200) is provided with a bore (220) extending axially in the longitudinal direction, in which bore a percussion member (300) is mounted for reciprocation for the purpose of firing a cartridge.

7. The device as defined in claim 1, characterized in that the fixing device as in itself in the form of an anchoring pin (231) anchored in opposing exterior walls (101, 102) of said breech device (100), which pin is positively mounted in a transverse bore (250) in said main functional member (200).

8. The device as defined in claim 1, characterized in that said main functional member (200) comprises two opposing portions (240) in a region near the rear breech end face (140), which portions are biased in the direction away from each other for the purpose of achieving a releasable lock by exerting a predefined pressure against the opposing exterior walls (101, 102) of said breech (100) device.

9. The device as defined in claim 1, characterized in that said rear end face (140) of said breech device (100) is open to make it possible to introduce said main functional member (200).

10. A breech device (100) for a handgun, comprising an impact base (120) that is disposed in a central recess (110) in said breech device (100) and is in the form of a front end face of an impact member (160) disposed in the central recess and a main functional region (150) disposed between said impact base (120) and a rear end face (140) of said breech device and in which at least one percussion member (300) for firing a cartridge and also a surface of a cartridge slide (211) are disposed and the surface of said cartridge slide (211) is adapted to abut cartridges mounted in a magazine (100) in a neutral position of said breech device, characterized in that:

the main functional region (150) includes a main functional member (200) forming a compact unit that can be releasably anchored securely by means of a fixing device in a predefined position in an internal profile of said central recess (110) in said breech device (100); and said main functional member (200) comprises two opposing portions (240) in a region near the rear breech end face (140), which portions are biased in the direction away from each other for the purpose of achieving a releasable lock by exerting a predefined pressure against the opposing exterior walls (101, 102) of said breech (100) device.

* * * * *